US007987986B2

(12) United States Patent
Leifeld

(10) Patent No.: US 7,987,986 B2
(45) Date of Patent: Aug. 2, 2011

(54) DEVICE AND USE FOR STORAGE AND PROVISION OF MEDICAMENT WAFERS

(75) Inventor: Sabine Leifeld, Berlin (DE)

(73) Assignee: Bayer Schering Pharma AG, Berlin (DE)

( * ) Notice: Subject to any disclaimer, the term of this patent is extended or adjusted under 35 U.S.C. 154(b) by 151 days.

(21) Appl. No.: 12/186,180

(22) Filed: Aug. 5, 2008

(65) Prior Publication Data

US 2009/0038981 A1 Feb. 12, 2009

Related U.S. Application Data

(60) Provisional application No. 60/954,118, filed on Aug. 6, 2007.

(30) Foreign Application Priority Data

Aug. 6, 2007 (DE) ..... 10 2007 037 374

(51) Int. Cl.
*B65D 83/04* (2006.01)

(52) U.S. Cl. ..... 206/534; 206/535

(58) Field of Classification Search ..... 206/534, 206/0.8, 0.83, 535, 538, 102, 311, 307.1, 206/425, 528, 232; 220/535; 53/411
See application file for complete search history.

(56) References Cited

U.S. PATENT DOCUMENTS

| | | | | |
|---|---|---|---|---|
| 1,719,962 | A * | 7/1929 | Beistle | 206/0.8 |
| 4,254,871 | A * | 3/1981 | Poore | 206/534 |
| 4,972,657 | A | 11/1990 | McKee | |
| 5,169,001 | A * | 12/1992 | Scheibel | 206/425 |
| 6,568,533 | B1 * | 5/2003 | Tanaka et al. | 206/484 |
| 6,669,236 | B1 * | 12/2003 | Hollwarth-Oberholz | 283/81 |
| 6,708,826 | B1 * | 3/2004 | Ginsberg et al. | 206/535 |
| 7,357,255 | B2 * | 4/2008 | Ginsberg et al. | 206/535 |
| 2004/0232028 | A1 | 11/2004 | Palm et al. | |
| 2005/0017018 | A1 | 1/2005 | Von Falkenhausen | |
| 2006/0157375 | A1 * | 7/2006 | DeJonge | 206/535 |
| 2007/0017847 | A1 | 1/2007 | Leifeld | |

FOREIGN PATENT DOCUMENTS

| | | |
|---|---|---|
| EP | 0 511 726 | 11/1992 |
| WO | WO 85/02828 | 7/1985 |
| WO | WO 2006/051406 A2 | 5/2006 |

* cited by examiner

*Primary Examiner* — Mickey Yu
*Assistant Examiner* — Rafael Ortiz
(74) *Attorney, Agent, or Firm* — Millen, White, Zelano & Branigan, P.C.

(57) ABSTRACT

To monitor the intake of medicaments present in wafer form, a device is made available which is suitable for storage and provision of such forms of administration. This device comprises medicament pouches, which are arranged as a stack of pouches and contain medicament wafers, and it has the following features: a) the device has a support 9 which extends parallel to an edge of the medicament pouches 1 and on which date indicators are arranged, b) a marking 20 is arranged on each of the medicament pouches 1 in such a way that markings 20 arranged on successive medicament pouches 1 in the stack of pouches are each in alignment with successive date indicators. This ensures monitoring of the intake of the wafers.

21 Claims, 2 Drawing Sheets

DEVICE AND USE FOR STORAGE AND PROVISION OF MEDICAMENT WAFERS

This application claims the benefit of the filing date of U.S. Provisional Application Ser. No. 60/954,118 filed Aug. 6, 2007.

FIELD OF THE INVENTION

The invention relates to a device and a use for storage and provision of medicament wafers, i.e. of medicaments in laminar form, in particular for contraception or for hormone replacement therapy.

PRIOR ART

Medicament wafers are film-shaped articles containing pharmaceutical active substances held in an active substance carrier. The active substances in the wafers can, for example, be administered by the transmucosal route, i.e. via the oral mucosa, by means of the wafers being placed on or under the tongue, after which the active substance carrier dissolves and in so doing releases the active substances. The wafers provided are enclosed in film pouches. According to DE 101 59 746 B4, these pouches can be composed of at least one support film and at least one cover film, in which case at least the film with the larger surface area has two parallel side edges, and the film-like or laminar material (wafer) is enclosed in a gas-tight and liquid-tight manner between the support film and the cover film. Devices for storage and provision of medicament wafers can contain film pouches stacked therein.

The device described in DE 101 59 746 B4 for storage and provision of wafers comprises a housing which is partitioned at least once and on whose lateral inner faces the side edges of the stacked film pouches bear, while the edge of a support film protruding beyond the edge of an associated cover film bears on a front inner face, and in which the stacked film pouches are pressed with spring-loading against the upper inner face of the housing. The front, upper area of the housing has two slits for separate ejection of the support film and cover film, the wafer being able to be provided with the support film or with the cover film. A separating tool for separating the support film from the cover film is arranged between the slits, on which separating tool the uppermost support film bears via its area lying in front of the front edge of the cover film. A transport element, which is rotatable about an axis of rotation, transports the medicament pouches out of the housing.

This device has the disadvantage that a user has no possibility of monitoring whether a wafer intended to be taken at a certain time has already been taken or not. As a result, two wafers can easily be taken instead of one, or the user completely forgets to take the wafer.

However, this possibility of monitoring is known for medicaments in blister packs, i.e. articles for storage of tablets, coated pills or the like, in which the tablets, coated pills or the like are contained in pockets embossed in a first film, and the film is connected to a second film that seals the pockets and can be torn off.

In EP 0 166 763 B1, for example, a blister pack is provided with a row of pockets for the tablets, where the pockets correspond in an unambiguous manner to the days of at least one calendar month and where, in addition, consecutive integer indicia are arranged in proximity to the pockets in such a way that each pocket can be visually identified with one and only one calendar day of the calendar month, and where consecutive integer indicia are arranged in proximity to tear-off zones in the second film in such a way that they are visible from the rear face of the second film, and where each zone can be visually identified with one and only one calendar day of the calendar month. Each pocket can therefore be visually identified, both from the front face and also from the rear face, with one and only one calendar day. Taking the tablets on a daily basis and monitoring user compliance is facilitated in this way.

Moreover, EP 0 511 726 B1 describes an arrangement which is used to receive tablets in an array and comprises the following: a blister pack with a predetermined surface area within which are located a plurality of tablets configured in a chosen array, a container for receiving the blister pack, and a day calendar which can be oriented with respect to the array of tablets in the blister pack, the day calendar being movable in order to position a selected start day on a first tablet in the array of tablets, and with pointers being provided on the container, and the blister pack has a locating notch near its edge and in proximity to a first tablet, such that the first tablet to be taken is indicated.

Furthermore, DE 10 2005 032 015 A discloses a case which receives a blister pack and comprises a first case half and a second case half hinged thereon. The first case half is designed as a pocket for receiving the blister pack and has an outer part and an inner viewing part and also first apertures in the viewing part and second apertures in the outer part, the first apertures being aligned with the second apertures, specifically at least where the receptacles for the tablets are located in the blister pack after it is received in the pocket. The second case half has a compartment for receiving a display means displaying days of the week, and windows for displaying the days of the week in an inner viewing surface of the second case half in the area of the compartment, the windows being arranged in such a way that they are assigned to the columns of the receptacles of a blister pack received in the pocket.

These embodiments of devices for storage and provision of medicament units relate to tablets in blister packs, however, and not to medicament wafers in medicament pouches.

It is therefore an object of the present invention to make available a device for storage and provision of medicament wafers.

Another object of the present invention is to ensure that the wafers are reliably removed from the device in a predetermined rhythm, i.e. that the device allows the user to monitor whether a medicament wafer has been taken as planned at a predetermined time.

A further object of the present invention is to make available a device for storage and provision of medicament wafers which is suitable for everyday use, has the required mechanical stability and can be produced easily and simply and therefore inexpensively.

A further object of the present invention is to provide a safe means of storing the medicament wafers.

SUMMARY OF THE INVENTION

These and other objects are achieved by the present invention.

A medicament pouch in the device according to the invention is typically composed of a base film and of a cover film. The cover film can be connected, for example glued, to the base film via a preferably strip-shaped join that extends along the side edges of the cover film. Moreover, in a particularly preferred embodiment, the base film and the cover film, on at least one side edge, each have protruding flaps that are not connected to each other. This makes it much easier to tear apart and thus open the medicament pouch in order to remove the wafer contained therein, because the two films can be easily gripped. A medicament wafer is enclosed between the base film and the cover film inside an area formed by the join.

The device according to the invention, which is used for storage and provision of medicament wafers, comprises medicament pouches which are arranged as a stack of pouches and contain medicament wafers. In the device, a support is arranged substantially parallel to an edge of the medicament pouches. To afford the user the possibility of monitoring whether a medicament has already been taken at a predetermined time, date indicators are arranged on the support, and a marking is arranged on each medicament pouch, such that markings arranged on successive medicament pouches in the stack of pouches are each in alignment with successive date indicators on the support.

By virtue of the fact that the medicament pouches in the device are arranged as a stack of pouches and are provided with mutually offset markings, and that display means for indicating the time at which the wafers are taken are arranged preferably on a support, substantially parallel to an edge of the medicament pouches, a user is at all times able to monitor if a wafer has already been taken at the actual intended time or if this is not the case.

DETAILED DESCRIPTION OF THE INVENTION

To secure the medicament pouches, with the wafers contained in them, in the device, the medicament pouches can be connected to the support preferably along the edge.

In a preferred embodiment of the invention, the support is formed by stub leaves which are arranged as a stack of leaves. These stub leaves are connected to one another at least in the area of a respective first leaf edge. Moreover, in this case, each medicament pouch is connected to one of the stub leaves via a respective second leaf edge opposite the first leaf edge, this also including the stub leaves being each formed in one piece with the medicament pouches, i.e. the medicament pouches being made wider at one edge thereof and forming the stub leaves at this widened edge. In this embodiment, the date indicators are arranged on a top stub leaf of the stack of leaves, along the second leaf edge thereof, or on a flap covering the top stub leaf.

Alternatively, the support can also be arranged adjacent to a first edge of the medicament pouches which lies opposite a second edge of the medicament pouches where the medicament pouches are connected to stub leaves via a respective second leaf edge lying opposite a first leaf edge of the stub leaves.

By means of the chosen structure of the device, the medicament pouches, with the wafers contained in them, are stacked together as in a notepad or book and can be removed one after another, preferably from the top. When the pouch lying at the top is removed in order to administer a wafer for a first time, the pouch lying below it in the stack becomes visible. This pouch lying underneath can then be removed during a subsequent second time of administration. The other pouches with the wafers can be removed according to the sequence of pouches in the stack. The pouches are each connected to stub leaves and are held by these in the stack. For removal, in one embodiment, a pouch can in each case be severed from the stub leaf to which it is connected. In an alternative embodiment, each pouch can be removed from the stack together with the connected stub leaf, for example by tearing it off or unstapling it.

By virtue of the fact that date indicators are arranged on a support, for example along the second leaf edge of a top stub leaf in the stack of leaves, and a marking is arranged on each of the medicament pouches in such a way that the markings arranged on the medicament pouches are each in alignment with the date indicators, the user can at all times tell if a pouch with a wafer has already been removed from the stack at the actual intended time, and the wafer has thus also been taken, or if this is not the case. It is possible to establish this from the fact that the marking located on the pouch is aligned with a defined date indicator on the adjacent support, preferably on the top stub leaf. In this way, the user can tell if the actual time falls within the period of time indicated by the date indicator of if this is not the case. Since the markings on successive pouches in the stack of pouches are in alignment with successive date indicators, removal of a top pouch from the stack of pouches reveals a marking on the pouch underneath, which is staggered by one unit of the date indicators, such that the time for the next administration is displayed. With this assignment of individual pouches to the date indicators on the stub leaves, it is easy to ensure reliable compliance with the administration schedule, since the user can tell from the marking on the top pouch, and from the date indicators on the support or along the leaf edge, whether a wafer has in fact to be removed and taken.

In a first embodiment in which the support is formed by a stack of leaves, and in which each pouch is removed from the attached stub leaf by being separated from the stack, date indicators are located only on a top stub leaf, since only this top stub leaf remains visible at all times. In a second embodiment in which the support is formed by a stack of leaves, and in which each pouch is removed from the stack together with the attached stub leaf, it is not only the top stub leaf, but every stub leaf connected to a pouch, that has to be provided with the date indicators, since the stub leaves are each removed at the same time as the pouches are removed. In this case, the support is formed by the respective top stub leaf together with all the stub leaves lying below it. However, since the date indicators in the latter case have to be arranged on all the stub leaves, the first embodiment is preferred over the second embodiment.

In a preferred further embodiment of the invention, each medicament pouch is connected separably to one of the stub leaves, for example by a perforation. In this way, the pouches can be easily removed from the stack, for example by being torn out. Each of the pouches can be produced in one unit together with an associated stub leaf, for example by means of the component parts of the pouches (base film, cover film) being made wider on one side. This part formed by the widening corresponds to the stub leaf.

If the wafers are to be taken daily, the date indicators, in a preferred embodiment, indicate days of the week or days of the calendar, the latter shown by the numbering of the days of a month. Compared to the indication of calendar days, indicators showing days of the week have the advantage of a more frequent rate of repetition. This permits an easier arrangement of date indicators on the support or on a top stub leaf, since for the first day only the matching day of the week has to be chosen from all seven days of the week, whereas, in the case of calendar days being indicated, the matching calendar day has to be chosen from 28, 29, 30 or 31 calendar days. Moreover, in the case of calendar days being indicated, at least as many calendar day indicators have to be arranged on the support or top stub leaf (at most 28, 29, 30 or 31 indications depending on the month) as there are pouches contained in the stack, since a repetition of the calendar day indicators takes place only at the start of a new month. In addition, it must be noted that the length of the month can be 28, 29, 30 or 31 days. This can easily lead to the device being used incorrectly. For this reason, the date indicators preferably indicate days of the week. In this case, it is preferable for seven days of the week to be indicated, preferably on the top stub leaf of the stack of leaves.

The days of the week, calendar days or other date indicators are preferably arranged on the support, preferably the top stub leaf, at the start of the period of administration of the wafers. For this purpose, the user arranges the date indicators on the support, preferably along the leaf edge, such that the date indicator for the first administration, for example for the first day of administration, lies either at the very top or at the very bottom, depending on the sequence of the markings on the successive medicament pouches, and the subsequent date indicators, for example days of the week, follow on above this or below this, in which process the pattern of markings on the medicament pouches has to be observed of course when applying the date indicators, such that the date indicators are in alignment with the markings.

The date indicators are preferably arranged on the support, in particular along the second leaf edge, by applying to the support a display means that comprises the date indicators. For example, a display strip containing the date indicators can be applied by slipping it into a holder on the support or by affixing it to the support. For example, the holder can be a slit in the support which, in the area of the date indicators arranged on the inserted display strip, has windows which permit viewing of the date indicators and permit assignment to an aligned marking on the top medicament pouch.

A display strip of this kind can, for example, initially have about twice as many successive date indicators as can be accommodated on the leaf edge, so as to be able to suitably prepare the display strip for application to the support. After determining when a wafer is to be taken for the first time, the associated date indicator on the display strip is assigned to the upper or lower position on the support, and the length of the display strip is then reduced to the length area corresponding to the available length on the support. For example, the display strip can be bent aside or cut off for application to the support above or below the date indicator for the first administration. Protruding parts of the display strip at the top or bottom can likewise be bent aside or cut off. The prepared display strip is then secured in the holder on the support, for example pushed into it or clamped there, or affixed to the support, such that the date indicators are in alignment with the markings on the medicament pouches.

Of course, the date indicators can also be applied in handwriting to the support.

The stub leaves are preferably connected to one another by clipping, gluing or stapling or by a ring binding or spiral binding. In principle, other types of connection are of course also conceivable. The stub leaves can for example be connected to one another by planar connection, for example by being glued to one another, in the area of their edge. An intimate and secure join of the individual stub leaves is achieved in this way. In another embodiment, the stub leaves can be hinged on one another. The latter is achieved by the stub leaves being connected to one another exclusively or mainly across the margins of the first leaf edge. In a particularly preferred embodiment, the stub leaves are connected or hinged to one another by a ring binding or a spiral binding, for example as in a notebook.

Moreover, an additional cover can be secured on at least one side of the stack of pouches in order to provide protection against mechanical or other effects, for example on the support or on the side of the stack of pouches opposite the support. In the closed state, this cover can bear on the outside of the stack of pouches. In one embodiment, the cover can be secured, particularly preferably hinged, on the support, and, in another embodiment, on that side of the stack of pouches opposite the support. The cover can be provided in particular for protection of the medicament pouches. The cover is made preferably of a stable material, for example card or plastic. The cover can be provided with an inscription or a logo or with some other arrangement that does not exclusively have functional purposes but also aesthetic purposes.

Moreover, in the area of the support, a cover can be connected thereto on one side of the stack of pouches and engage across both sides of the stack of pouches by being folded back at a side edge of the medicament pouches that lies opposite the support. For example, such a cover can be folded or bent from a sheet of card or plastic. The cover can be connected via one of its edges to the support and, at a distance therefrom and preferably parallel thereto, can have a fold that permits the folding back across the stack of pouches. The cover can thus completely cover both the front face and also the rear face of the stack of pouches and effectively protect the latter. The fold in the cover is preferably of such a width that it comfortably engages the thickness of the stack of pouches. In the closed state of the cover, the top pouch is protected by the free, folded-back front area of the cover, while the rear part of the cover connected to the support protects the rear face of the stack of pouches. Moreover, in the area in which it is connected to the support, the cover can be folded forwards over the connection site and across the stack of leaves and cover the latter. Thus, in this case, the support is formed by the stack of leaves and by the cover folded around. The stack of leaves is in this way also protected against mechanical damage. Therefore, instead of being arranged on the stack of leaves, the date indicators according to the present invention can be arranged on a flap on the stack of leaves, which flap is created by the cover being folded about the stack of leaves. In this case, the stack of leaves and the flap together form the support. Such configurations are known from booklets of matches, for example. Their production is simple and efficient.

Alternatively, the cover engaging across both sides of the device can also be secured on the device at the side of the stack of pouches lying opposite the stack of leaves, and it can be folded back across the side on which the stack of leaves is arranged. In this case, the support can be arranged, for example, on the side of the stack of pouches lying opposite the stack of leaves, and the folding of the cover forms for example the support.

The device according to the invention can preferably contain 120 medicament pouches for receiving medicament wafers in a stack of pouches. For contraception, it has hitherto been customary for one administration unit, i.e. one wafer, to be taken within 21 days, this administration phase being followed by a medication-free phase of 7 days. In the case of modern contraceptives, however, administration cycles are used that last longer than 21 days, for example up to 120 days. This longer administration phase is then followed by a medication-free phase of 4 days. To be able to provide wafers in sufficient number for such a case, it is possible to provide 120 medicament pouches in the device.

The figures and examples described below will provide a more detailed explanation of the invention. Of course, the embodiments shown in the figures and examples are provided only by way of illustration. This illustration does not limit the scope of the invention. Rather, the description below will reveal to a person skilled in the art not only the particular variants of the invention that are shown here, but also undisclosed variants according to the invention that he will easily be able to arrive at.

The same reference numbers in the figures designate the same features.

Figure 1:
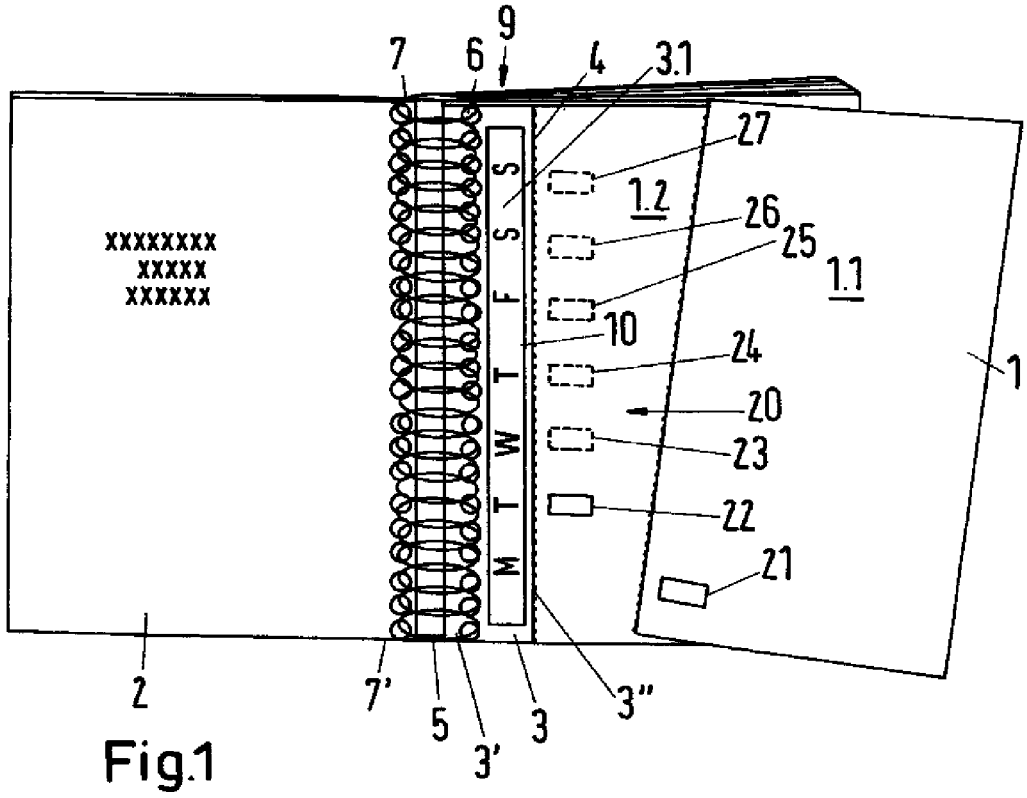
FIG. 1 shows a perspective view of a first embodiment of the invention.

A device according to the invention, for storage and provision of wafers, is shown in FIG. 1. The device comprises a cover 2, for example of plastic, and a plurality of medicament pouches 1 in which the wafers are enclosed (not shown). The reverse of the device can be provided with another cover (not shown) which protects the medicament pouches 1 from mechanical damage. Each of the medicament pouches 1 has at its side a stub leaf 3 which, at a second leaf edge 3", is separated from the medicament pouch 1 only by a perforation 4. The perforation 4 is used for tearing a medicament pouch 1 from the stub leaf 3 when needed, in order to be able to remove this pouch 1 from the device. The stub leaf 3 remains behind. This is shown in FIG. 1: the top medicament pouch 1.1 has already been removed from the top stub leaf 3.1 by being torn off, and a bound medicament pouch 1.2 underneath it has become visible, which is still connected to the associated stub leaf (not visible) via the perforation 4. It is possible for the device to contain, for example, 120 medicament pouches 1. The cover 2 has an inscription which serves, for example, to provide directions for use and to identify the medicament and the manufacturer.

The medicament pouches 1, with the stub leaves 3 attached to them, and the cover 2 are connected to one another in the manner of a booklet bound by a ring binding. For this purpose, first holes 6 are provided in a first leaf edge 3' of the stub leaves 3 on each medicament pouch 1, and one of the edges 7' of the cover is provided with second holes 7 through which rings 5 of the ring binding engage.

The stub leaves 3 form a stack of leaves that forms a support 9 for date indicators. For this purpose, the top stub leaf 3.1 has date indicators that are arranged on a days-of-the-week strip 10. The date indicators in this case show days of the week, here represented by the letters "M" (Monday), "T" (Tuesday), "W" (Wednesday), "T" (Thursday), "F" (Friday), "S" (Saturday), "S" (Sunday). This days-of-the-week strip is in the present case affixed to the top stub leaf 3.1. The day indicator "M" for Monday is arranged at the very bottom, and the other days of the week are indicated in chronological order upwards from this. The day indicator "S" for Sunday is the last in this series. Choosing this arrangement of the day indicators on the days-of-the-week strip 10 makes clear that the first wafer is intended to be taken on a Monday. If, for example, the first wafer was to have been taken on a Thursday (corresponding to "T"), the days-of-the-week strip 10 would have had to be affixed in another format on the top stub leaf 3.1, namely in the sequence (from below): T, F, S, S, M, T, W. The same applies to other schedules for taking the medicament. It is therefore preferable, before the start of treatment, to provide a user with a days-of-the-week strip 10 which can be used to prepare the device and on which all the days of the week are printed in sequence about twice, such that the user can prepare the display strip 10 with the 7 date indicators arranged in a sequence beginning with the day of the week chosen for the start of treatment. The end parts of the days-of-the-week strip 10 that are not needed are then cut off (or, if appropriate, are folded back if the strip 10 is secured in a holder or is pushed into a slit).

Markings 20 are also arranged on the medicament pouches 1. The first medicament pouch 1.1 has a first marking 21, which is in alignment with the day of the week indicator "M"=Monday on the days-of-the-week strip 10. Thus, the wafer contained in this pouch is intended to be taken on a Monday. The medicament pouch 1.2, which is located underneath and becomes visible when the top medicament pouch 1.1 is torn off, has a second marking 22, which is in alignment with the day of the week indicator "T" for Tuesday on the days-of-the-week strip 10. The wafer in this second pouch 1.2 is therefore to be taken on a Tuesday. Further markings 23, 24, 25, 26, 27 are only indicated symbolically here, since they are hidden in the indicated sequence on the subsequent medicament pouches 1. Each of these markings 23, 24, 25, 26, 27 is in alignment with one of the days of the week indicators "W" for Wednesday, "T" for Thursday, "F" for Friday, "S" for Saturday and "S" for Sunday (in the stated sequence). The wafers contained in the medicament pouches located below are therefore to be taken on the corresponding days of the week. It is thus immediately clear to the user if a wafer has already been taken on a particular day or if this is not the case.

Figure 2:
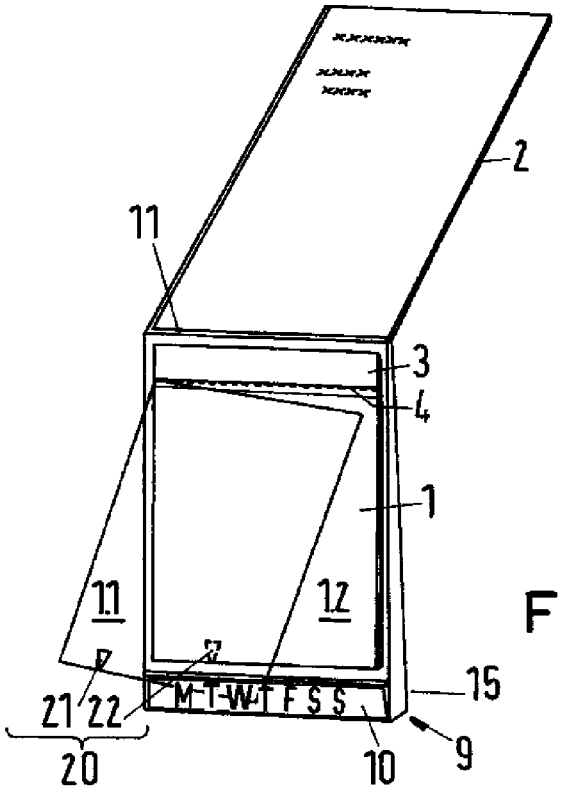
FIG. 2 shows a perspective view of a second embodiment of the invention in the state when opened.

FIG. 2 shows a second embodiment of the invention. The device once again has a cover 2, for example of board, and medicament pouches 1. The cover 2 in this case also has an inscription that can be used to provide directions for use or to identify the medicament and the manufacturer. The cover 2 can be connected to a stack of leaves by gluing. This stack of leaves comprises a plurality of stub leaves 3, which are glued to one another. These stub leaves 3 are separated from the medicament pouches 1 by a perforation 4. To produce a medicament pouch 1 with a stub leaf 3, the necessary base film and cover film are suitably prepared so as to form not only the medicament pouch 1 but also at the same time the adjoining stub leaf 3. For this purpose, said base and/or cover films are to be made suitably larger than is needed to receive the wafers. After production of the pouches 1, with the wafers located in them, and formation of the perforation that is used to separate each of the medicament pouches 1 from the associated stub leaf 3, the medicament pouches 1 are stacked together with the stub leaves 3 in order to produce the device, and the stub leaves 3 are glued exclusively in the area of the stub leaves 3. The stack of leaves resulting from the gluing of the stub leaves 3 can be connected to the cover 2 by adhesive bonding.

In the lower area of the device, the cover 2 is folded back towards the stack of pouches in order to form a flap 15. The support 9 for the date indicators is formed in this way. Above the stack of leaves, the cover 1 forms an upper fold 11, such that the cover 2 can be folded back across the front face of the stack of pouches.

A days-of-the-week strip 10 showing the day indicators "M", "T", "W", "T", "F", "S", "S" is affixed to the support 9. The strip is prepared as in the example in FIG. 1, such that the start date appears on the far left of the strip 10, and is affixed to the support 9. The medicament pouches 1 are also provided with markings 20, which are in alignment with the day indicators on the days-of-the-week strip 10. A marking 21 in alignment with the day indicator "M" is arranged on the top medicament pouch 1.1, and a second marking 22 in alignment with the day indicator "T" is arranged on the medicament pouch 1.2 underneath. This second marking 22 is only shown symbolically here. Further markings are not shown, because they are concealed by the medicament pouches 1 lying in front of them.

Figure 3:
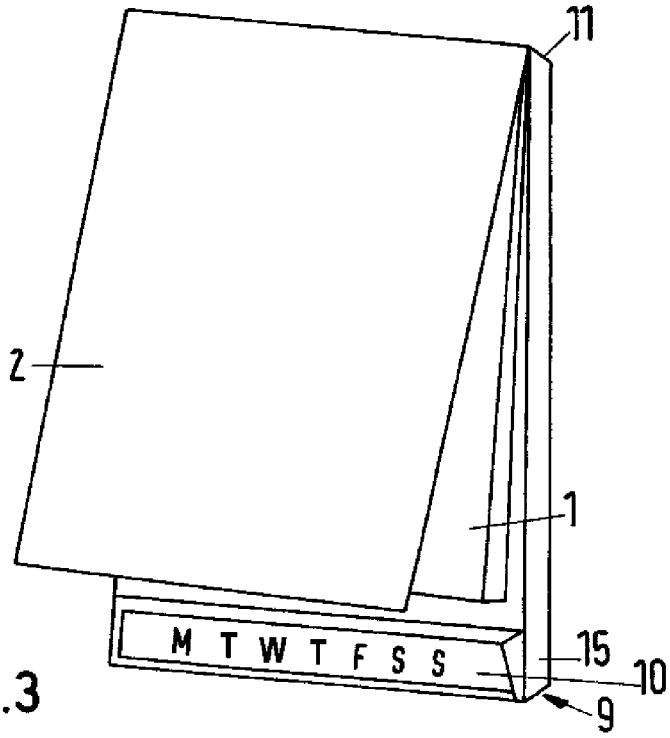
FIG. 3 shows a perspective view of the second embodiment of the invention in the state when closed.

FIG. 3 shows the second embodiment of the device according to the invention in the state when closed. An inscription and logos can be arranged on the outside of the cover 2.

Figure 4:
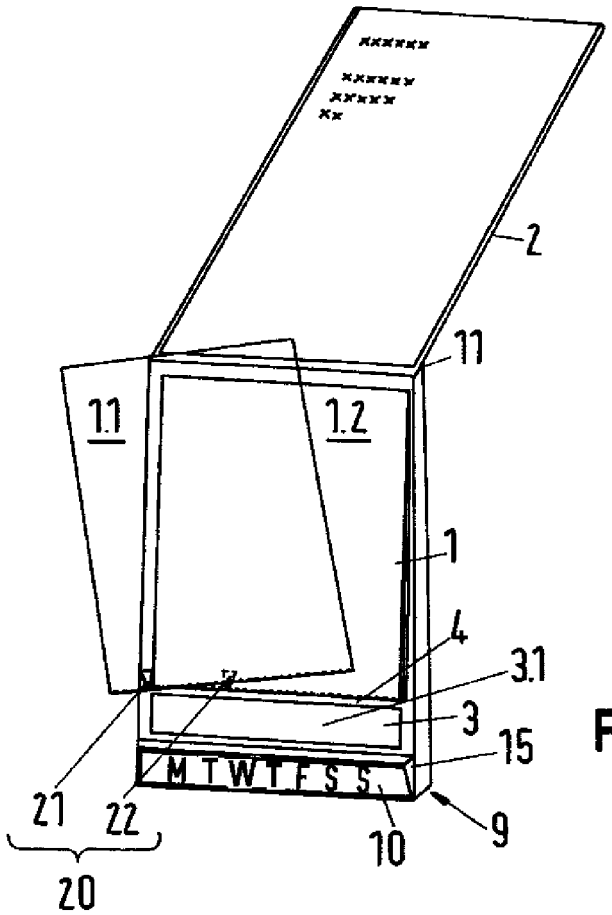
FIG. 4 shows a perspective view of a third embodiment of the invention.

FIG. 4 shows a third embodiment of the device according to the invention. This device is formed like a booklet of matches. The inside face of the cover 2 is provided with an inscription, for example directions for use including the name of the medicament and the name of the manufacturer. In the lowermost area of the device, the cover 2 forms a flap 15 by way of a lower fold, by means of the cover 2 being guided round a stack of stub leaves 3 and secured there. The cover 2 does not cover the stub leaves 3 completely, however. It will be seen in FIG. 4 that the stack of leaves protrudes partially relative to the flap 15. The support 9 is formed by the flap 15 and the stack of leaves. The cover 2 protects the rear face of the stack of pouches and is kinked at an upper fold 11 onto the front face of the device, such that it can also protect the front face of the stack of pouches against mechanical damage.

The stub leaves 3 are connected to the associated medicament pouches 1 via a perforation 4. As in the case of the device according to FIG. 2, the medicament pouches 1 can be produced in one piece with the associated stub leaves 3. The two parts can be separated from each other with the aid of the perforation 4.

A days-of-the-week strip 10 showing the day indicators "M", "T", "W", "T", "F", "S", "S" is once again arranged on the support 9. The medicament pouches 1 have markings 20, which are in alignment with the associated day indicators. In the example shown, the series of days of the week begins with "M" for Monday and ends with "S" for Sunday. A first medicament pouch 1.1 lying at the top is torn off from the support 3 with the aid of the perforation 4. Part of the top stub leaf 3.1 is visible. The detached pouch 1.1 has a first marking 21 in alignment with "M" for Monday. A medicament pouch 1.2 lying underneath is visible. This second pouch 1.2 has a second marking 22 aligned with the day indicator "T" for Tuesday. By means of the markings 20 assigned to the day indicators, it is possible for the user to tell if a wafer has already been taken at the planned time, or if this is not the case.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding German application No. 10 2007 037 374.2, filed Aug. 6, 2007, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A device for storage and provision of medicament wafers, said device comprising:

medicament pouches (1) which are arranged as a stack of pouches, each pouch containing a medicament wafer, a support (9) which extends parallel to an edge of the stack of medicament pouches (1) and on which date indicators are arranged, marking (20) arranged on each of the medicament pouches (1) in such a way that markings (20) arranged on successive medicament pouches (1) in the stack of pouches are each in alignment with successive date indicators on said support (9), said stack of medicament pouches (1) having a first edge and a second edge and said first edge lies opposite said second edge, and said support (9) is arranged adjacent to said first edge of said stack of medicament pouches (1), and a plurality of stub leaves (3) which are arranged as a stack of leaves at said second edge of said stack medicament pouches (1), wherein each stub leaf (3) has a respective first leaf edge (3') and a respective second leaf edge (3") arranged opposite said first leaf edge (3'), and each of said medicament pouches (1) is connected to a stub leaf (3) via the respective second leaf edge of said stub leaf (3).

2. The device for storage and provision of medicament wafers according to claim 1, wherein said medicament pouches (1) are connected to the support (9).

3. The device for storage and provision of medicament wafers according to claim 2, wherein said support (9) is formed by said stub leaves (3) which are arranged as a stack of leaves, and wherein said stub leaves (3) are connected to one another at least in the area of said respective first leaf edge (3').

4. The device for storage and provision of medicament wafers according to claim 3, wherein said date indicators are arranged on a top stub leaf (3.1) of the stack of leaves, along the second leaf edge (3") thereof, or on a flap (15) covering the top stub leaf (3.1), said flap (15) and said stack of leaves thereby forming said support (9).

5. The device for storage and provision of medicament wafers according to claim 3, wherein said stub leaves (3) are connected to one another by clipping, gluing or stapling.

6. The device for storage and provision of medicament wafers according to claim 3, wherein said stub leaves (3) are hinged on one another.

7. The device for storage and provision of medicament wafers according to claim 3, wherein each medicament pouch (1) is separably connected to one of the stub leaves (3).

8. The device for storage and provision of medicament wafers according to claim 3, wherein each medicament pouch (1) is connected separably to one of the stub leaves (3) by a perforation (4).

9. The device for storage and provision of medicament wafers according to claim 1, wherein said date indicators indicate days of the week or days of the calendar.

10. The device for storage and provision of medicament wafers according to claim 1, wherein said date indicators indicate days of the week, and wherein seven days of the week are indicated on said support (9).

11. The device for storage and provision of medicament wafers according to claim 1, wherein said date indicators are applied to said support (9) by means of a display strip (10) that carries the date indicators being slipped into a holder on the support (9).

12. The device for storage and provision of medicament wafers according to claim 1, further comprising an additional cover (2) for protecting the medicament pouches (1) on at least one side of the stack of pouches.

13. The device for storage and provision of medicament wafers according to claim 1, wherein, in the area of the support (9), a cover (2) is connected thereto on one side of the stack of pouches and engages across both sides of the stack of pouches by being folded back at a side edge of the medicament pouches (1) that lies opposite the support (9).

14. The device for storage and provision of medicament wafers according to claim 1, wherein said stack of pouches contains 120 medicament pouches (1) for receiving medicament wafers.

15. The device for storage and provision of medicament wafers according to claim 1, wherein each medicament pouch (1) comprises a base film having side edges and a cover film having side edges, said cover film is connected to the base film via a join that extends along the side edges of the cover film, and, on at least one side edge thereof, said base film and the cover film each have protruding flaps that are not connected to each other, and wherein a medicament wafer is enclosed between said base film and said cover film inside an area formed by the join.

16. The device for storage and provision of medicament wafers according to claim 3, wherein said stub leaves (3) are connected to one another by a ring binding or spiral binding.

17. The device for storage and provision of medicament wafers according to claim 1, wherein said date indicators are applied to said support (9) by means of a display strip (10) affixed to said support (9).

18. The device for storage and provision of medicament wafers according to claim 2, wherein said support (9) if formed by said stub leaves (3) which are arranged as a stack of leaves, and wherein said stub leaves (3) are connected to one another at least in the are of said respective first leaf edge (3'), and each of said stub leaves (3) being each formed in one piece with a medicament pouch (1), and said date indicators are arranged on a top stub leave (3.1) of the stack of leaves, along the second leaf edge (3") thereof, or on a flap (15) covering the top stub leaf (3.1), said flap (15) and said stack of leaves thereby forming said support (9).

19. The device for storage and provision of medicament wafers according to claim 1, wherein said wafers are medicaments for contraception.

20. The device for storage and provision of medicament wafers according to claim 1, wherein said wafers are medicaments for hormone replacement therapy.

21. The device for storage and provision of medicament wafers according to claim 16, further comprising a cover (2) wherein said medicament pouches (1) with their attached stub leaves (3) and the cover are connected to one another as a booklet via said ring or spiral binding, wherein the cover (2) and the first leave edges of the stub leaves are provided with holes for said ring or spiral binding.

* * * * *

UNITED STATES PATENT AND TRADEMARK OFFICE

CERTIFICATE OF CORRECTION

PATENT NO. : 7,987,986 B2
APPLICATION NO. : 12/186180
DATED : August 2, 2011
INVENTOR(S) : Sabine Leifeld It is certified that error appears in the above-identified patent and that said Letters Patent is hereby corrected as shown below:

Column 12, line 1 reads: "said support (9) if formed by said stub leaves (3) which are" should read --said support (9) is formed by said stub leaves (3) which are--.

Column 12, line 3 reads: "leaves (3) are connected to one another at least in the are" should read --leaves (3) are connected to one another at least in the area--.

Column 12, line 23 reads: "and the first leave edges of the stub leaves are provided with" should read --and the first leaf edges of the stub leaves are provided with--.

Signed and Sealed this
Fifteenth Day of November, 2011

David J. Kappos

David J. Kappos
*Director of the United States Patent and Trademark Office*